US009261255B2

(12) United States Patent
Kang

(10) Patent No.: US 9,261,255 B2
(45) **Date of Patent: *Feb. 16, 2016**

(54) LIGHT SOURCE MODULE AND LAMP FOR VEHICLE HAVING THE SAME

(71) Applicant: HYUNDAI MOBIS CO., LTD., Seoul (KR)

(72) Inventor: Dong Gon Kang, Yongin (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/191,368

(22) Filed: Feb. 26, 2014

(65) Prior Publication Data

US 2015/0043234 A1 Feb. 12, 2015

(30) Foreign Application Priority Data

Aug. 6, 2013 (KR) ..... 10-2013-0093222

(51) Int. Cl.
*F21V 9/00* (2015.01)
*F21S 8/10* (2006.01)

(52) U.S. Cl.
CPC ..... *F21S 48/24* (2013.01); *F21S 48/215* (2013.01); *F21S 48/2212* (2013.01); *F21S 48/2243* (2013.01); *F21S 48/2268* (2013.01); *F21S 48/2281* (2013.01); *F21S 48/23* (2013.01)

(58) Field of Classification Search
CPC ..... F21S 48/215; F21S 48/24; F21S 48/2212; F21S 48/2243; F21S 48/2268; F21S 48/2281; F21S 48/23
USPC ..... 362/511
See application file for complete search history.

(56) References Cited

U.S. PATENT DOCUMENTS

2010/0165603 A1* 7/2010 Sun et al. ..... 362/97.2
2011/0050558 A1* 3/2011 Park et al. ..... 345/102

* cited by examiner

*Primary Examiner* — Anh Mai
*Assistant Examiner* — Hana Featherly

(57) ABSTRACT

An light source module according to an embodiment of the present invention includes: a substrate; a light source which is provided on the substrate; a reflective sheet which is stacked on the substrate; an optical sheet which is stacked on the reflective sheet and has a protruding pattern; an optical resin which is formed on the protruding pattern; and a light diffusion sheet which is stacked on the optical resin, and the light source module may implement a surface emission image, and diffuse light so as to satisfy regulations on visible angle light distribution.

9 Claims, 3 Drawing Sheets

LIGHT SOURCE MODULE AND LAMP FOR VEHICLE HAVING THE SAME

CROSS-REFERENCE TO RELATED APPLICATIONS

This application claims priority to and the benefit of Korean Patent Application No. 10-2013-0093222 filed in the Korean Intellectual Property Office on Aug. 6, 2013, the entire contents of which are incorporated herein by reference.

FIELD

The present invention relates to a light source module and a lamp for a vehicle having the same, and more particularly, to a light source module which implements a surface emission image, and a lamp for a vehicle having the same.

BACKGROUND

In general, lamps for a vehicle are widely classified into a headlamp which is installed at a front side of a vehicle, and a tail lamp which is installed at a rear side of the vehicle. The tail lamp performs functional roles, such as a brake operation display, a direction display, or an alarm display, and also performs an aesthetic role for forming an image of a rear side of a vehicle. Considering the situation in which importance of a design of a vehicle in a product value of a vehicle is gradually increased, aesthetic appearance of the tail lamp may be a very important factor in improving a product value of a vehicle.

However, a general tail lamp has a simple configuration including a bulb that is a light source, and a reflector that reflects light of the bulb. For this reason, there is a problem in that shapes of lighting images of the tail lamp are unified. Therefore, a method of increasing aesthetic appearance of lighting images by installing a plurality of light sources such as LEDs has been proposed, which leads to a problem in that a large number of light sources are required.

A demand for surface emission images utilizing indirect reflection rather than the lighting images configured to have a multi-dot shape has been increased due to an increase in an index of emotional quality of a consumer.

However, because optical efficiency of the surface emission images is low, there are problems in that it is difficult to satisfy regulations on visible angle light distribution, and a stereoscopic effect of the lighting images is insufficient.

SUMMARY

The present invention has been made in an effort to provide an light source module which may improve optical efficiency, exhibit a stereoscopic effect, and implement a surface emission image, and a lamp for a vehicle having the light source module.

An embodiment of the present invention provides a light source module including: a substrate; a light source which is provided on the substrate; a reflective sheet which is stacked on the substrate; an optical sheet which is stacked on the reflective sheet and has a protruding pattern; an optical resin which is formed on the protruding pattern; and a light diffusion sheet which is stacked on the optical resin.

The light source may include at least two light emitting diodes.

The optical resin may be any one of polymethyl methacrylate and silicone.

Another embodiment of the present invention provides a lamp for a vehicle, including: a light source module which includes a substrate, a light source that is provided on the substrate, a reflective sheet that is stacked on the substrate, an optical sheet that is stacked on the reflective sheet and has concave-convex portions, and an optical resin that is formed on the concave-convex portions; and an inner lens which is formed above the optical resin so as to be spaced apart from the optical resin.

Concave-convex portions may be formed on a light exit surface of the inner lens.

The light source may include at least two light emitting diodes.

The optical resin may be any one of polymethyl methacrylate and silicone.

The light source module according to the present invention and the lamp for a vehicle having the light source module provide advantageous effects in that the optical resin is stacked on the light source so as to implement a surface emission image, and the light diffusion sheet is stacked on the optical resin so as to diffuse light so that regulations on visible angle light distribution are satisfied.

The foregoing summary is illustrative only and is not intended to be in any way limiting. In addition to the illustrative aspects, embodiments, and features described above, further aspects, embodiments, and features will become apparent by reference to the drawings and the following detailed description.

Figure 1:
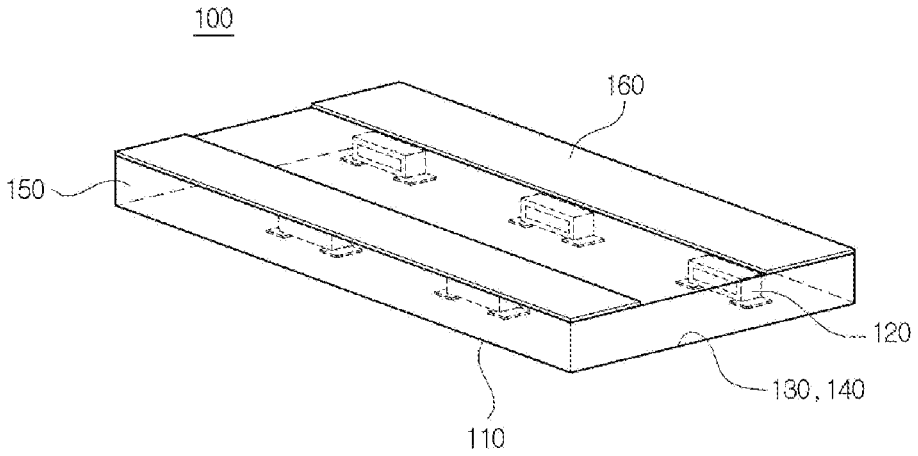
FIG. 1 is a view illustrating a light source module according to an embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, an embodiment of the present invention will be described in detail with reference to the accompanying drawings. First, in denoting reference numerals to constituent elements of respective drawings, it should be noted that the same elements will be designated by the same reference numerals although they are shown in different drawings. Hereinafter, an embodiment of the present invention will be described, but, of course, the technical spirit of the present invention is not restricted or limited thereto, but the embodiment of the present invention may be modified by a person with ordinary skill in the art to be variously performed.

Figure 2:
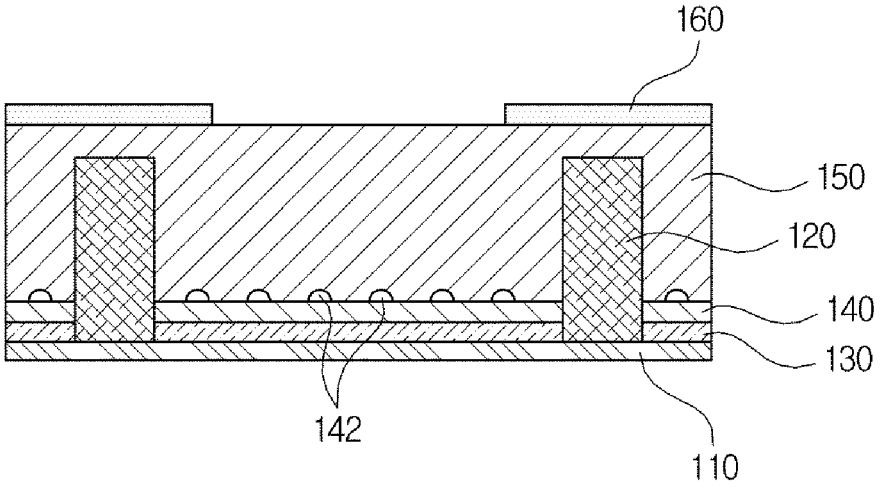
FIG. 2 is a view illustrating the interior of the light source module illustrated in FIG. 1.

FIGS. 1 and 2 clearly illustrate only main characteristic parts for conceptual and clear understanding of the present invention. As a result, various modifications to the illustrations are expected, and the scope of the present invention does not have to be limited to specific shapes illustrated in the drawings.

FIG. 1 is a view illustrating a light source module according to an embodiment of the present invention, and FIG. 2 is a view illustrating the interior of the light source module illustrated in FIG. 1.

Referring to FIGS. 1 and 2 together, a light source module 100 according to an embodiment of the present invention includes a substrate 110, a light source 120, a reflective sheet 130, an optical sheet 140, an optical resin 150, and a light diffusion sheet 160.

The light source 120 is provided on the substrate 110 having a flat panel shape. The plurality of light sources 120 may be provided on the substrate 110 so as to be aligned in at least any one direction of a longitudinal direction and a lateral direction. The light source 120 may be a light emitting diode (LED). The light emitting diode may be a side view type light emitting diode in which light is emitted from a side thereof The reflective sheet 130 is stacked on the substrate 110. The reflective sheet 130 serves to specularly reflect light emitted from the light source 120. Here, the specular reflection means that light is reflected so that an incidence angle and a reflection angle are identical to each other.

The optical sheet 140 is stacked on the reflective sheet 130. A fine protruding pattern 142 may be formed on the optical sheet 140. A path of the light emitted from the light source 120 is converted by the protruding pattern 142, such that a stereoscopic effect may be implemented at the light source module 100 which is overall implemented in the form of a flat panel.

The optical resin 150 is stacked on the optical sheet 140. The optical resin 150 totally reflects the light emitted from the side of the light source 120, and guides the corresponding light to move in a horizontal direction. The optical resin 150 leads the light, which is emitted from the light source 120 of a spot light source type, to implement a surface emission image.

A light path of a part of the light, which is totally reflected by the optical resin 150, is changed by the reflective sheet 130, such that a lighting image having a stereoscopic effect of a 3D shape is implemented at the light source module 100 having a flat panel shape.

Figure 3:
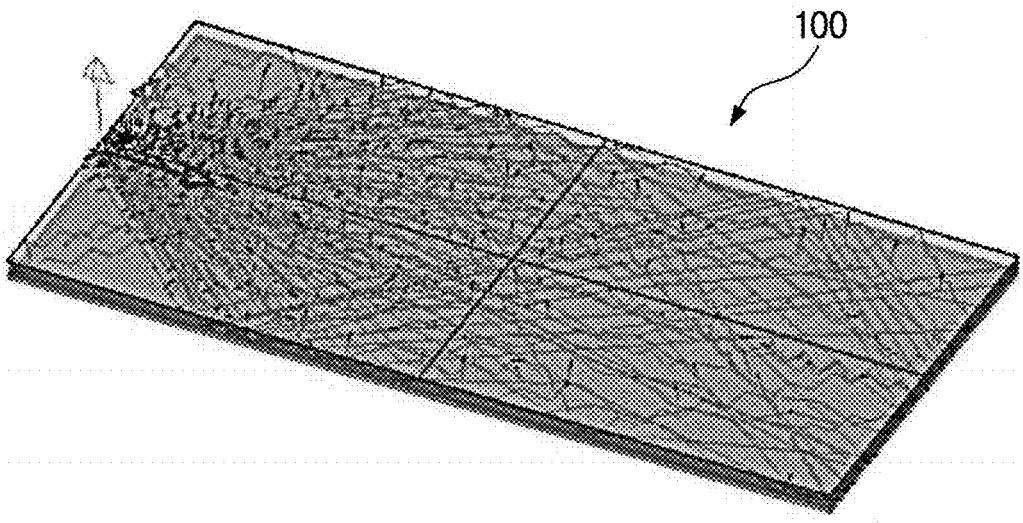
FIG. 3 is a view illustrating a path of light emitted from a light source of the light source module illustrated in FIG. 1.
Figure 4:
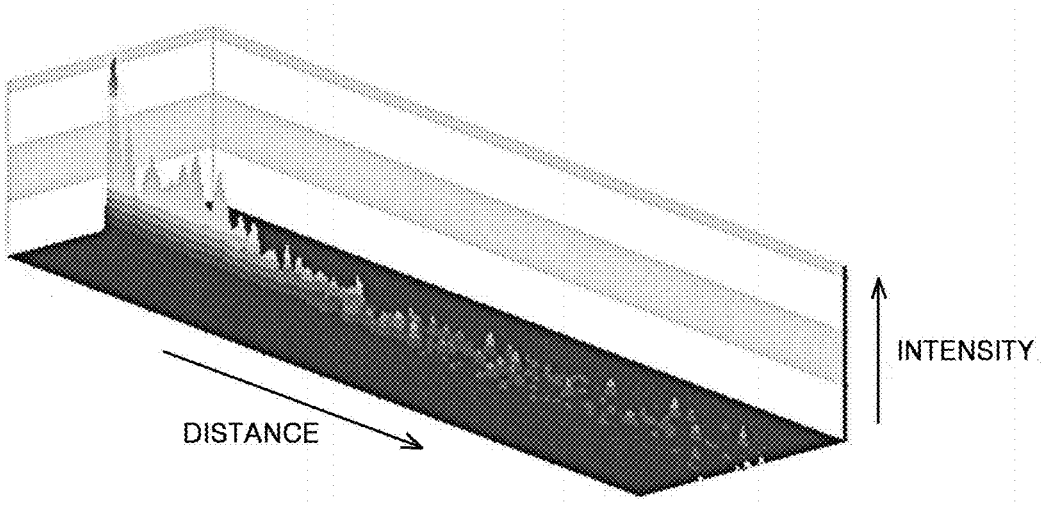
FIG. 4 is a graph illustrating a relationship between intensity of light emitted from the light source of the light source module illustrated in FIG. 1 and a distance from the light source.

FIG. 3 is a view illustrating a path of light emitted from a light source of the light source module illustrated in FIG. 1, and FIG. 4 is a graph illustrating a relationship between intensity of light emitted from the light source of the light source module illustrated in FIG. 1 and a distance from the light source.

Referring to FIG. 3, the light totally reflected by the optical resin 150 moves along the light source module 100 having a flat panel shape so as to produce a surface emission image. Referring to FIG. 4, as a distance from the light source becomes increased, intensity of light is decreased, such that a stereoscopic effect is implemented. However, in the case of the light source module in which a stereoscopic effect is implemented, the light source module has a characteristic in that light is reflected only in a specific direction, and as a result, it is difficult to satisfy regulations on visible angle light distribution.

Here, for example, the regulation on visible angle light distribution refers to a regulation which states that a lamp for a vehicle needs to be designed so that a predetermined or more amount of light is emitted within a region from 45° in one side direction to 80° in the other side direction, based on the lamp for a vehicle.

Accordingly, the light source module 100 according to the embodiment of the present invention may include the light diffusion sheet 160.

The light diffusion sheet 160 is stacked on the optical resin 150, and serves to diffuse light so as to satisfy the regulations on visible angle light distribution. The light diffusion sheet 160 may be installed at a position that corresponds to a position of the light source 120. For example, the plurality of light diffusion sheets 160 may be formed to elongate in a direction in which the light sources 120, which are aligned in the longitudinal direction or the lateral direction, are aligned.

The light diffusion sheet 160 may be bonded with the optical resin 150 using a pressure sensitive adhesive (PSA).

Figure 5:
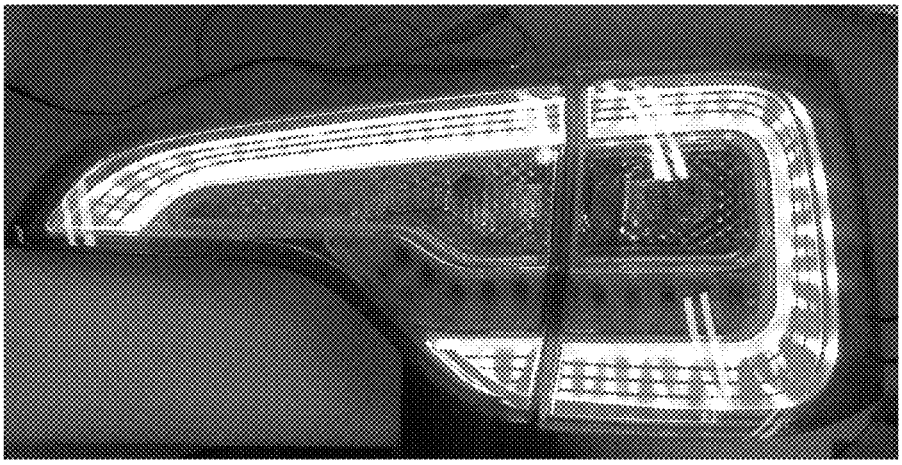
FIG. 5 is a photograph illustrating a surface emission image that is implemented by the light source module illustrated in FIG. 1.

FIG. 5 is a photograph illustrating a surface emission image that is implemented by the light source module illustrated in FIG. 1. Referring to FIG. 5, it may be confirmed that a surface emission image is implemented by the light diffusion sheet 160 at a portion where the light source (120 in FIG. 1) is positioned, and a light emitting image having a three-dimensional shape is implemented in the other regions.

Figure 6:
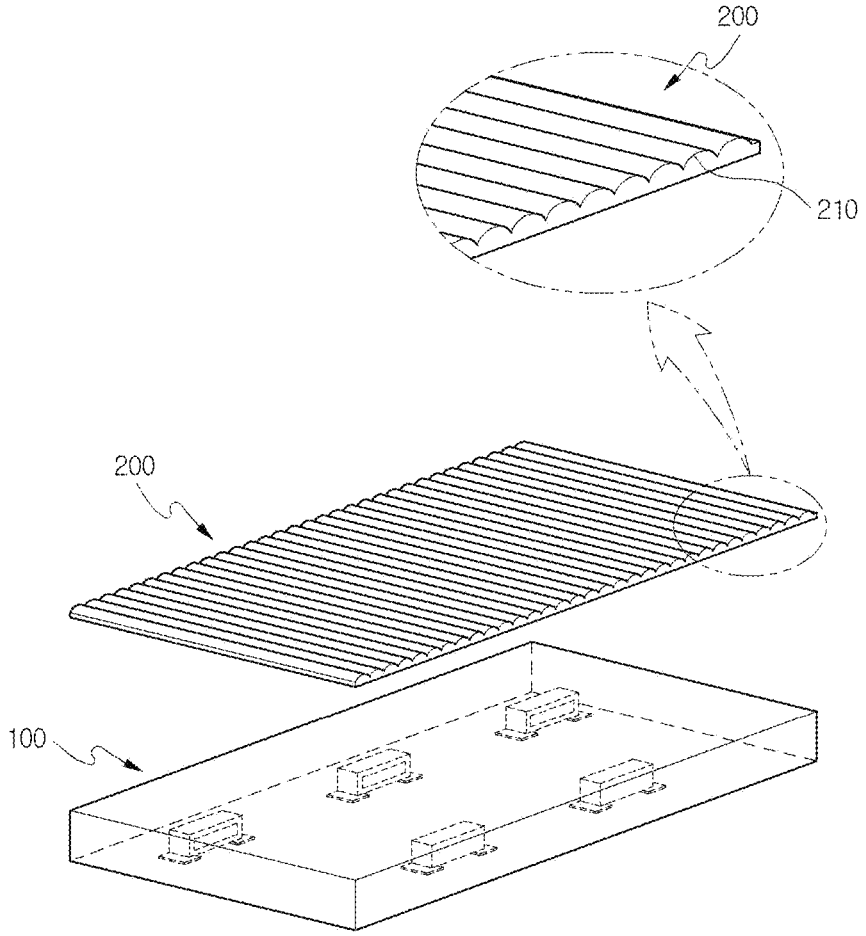
FIG. 6 is a view illustrating a lamp for a vehicle according to an embodiment of the present invention.

FIG. 6 is a view illustrating a lamp for a vehicle according to an embodiment of the present invention.

A lamp for a vehicle according to an embodiment of the present invention may include an inner lens 200 that is substituted for the aforementioned light diffusion sheet 160 of the light source module 100. The inner lens 200 may be disposed to be spaced apart from the light source module 100 at a predetermined interval.

Meanwhile, concave-convex portions 210 may be formed on an light exit surface of the inner lens 200. Lighting images having various three-dimensional shapes may be implemented correspondingly to the shapes of the concave-convex portions 210.

As described above, the embodiments have been described and illustrated in the drawings and the specification. The embodiments were chosen and described in order to explain certain principles of the invention and their practical application, to thereby enable others skilled in the art to make and utilize various embodiments of the present invention, as well as various alternatives and modifications thereof As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A light source module comprising:

a substrate;

a light source disposed on the substrate;

a reflective sheet disposed on the substrate;

an optical sheet disposed on the reflective sheet and having a protruding pattern;

an optical resin disposed on the protruding pattern and directly coupled to the light source; and a first light diffusion sheet disposed on the optical resin.

2. The light source module of claim 1, wherein the light source includes at least two light emitting diodes.

3. The light source module of claim 1, wherein the optical resin is any one of polymethyl methacrylate and silicone.

4. A lamp for a vehicle, comprising:

a light source module which includes a substrate, a light source disposed on the substrate, a reflective sheet disposed on the substrate, an optical sheet disposed on the reflective sheet and having concave-convex portions, and an optical resin disposed on the concave-convex portions, the optical resin being directly coupled to the light source; and an inner lens disposed above the optical resin so as to be spaced apart from the optical resin.

5. The lamp of claim 4, wherein concave-convex portions are disposed on a light exit surface of the inner lens.

6. The lamp of claim 4, wherein the light source includes at least two light emitting diodes.

7. The lamp of claim 4, wherein the optical resin is any one of polymethyl methacrylate and silicone.

8. A light source module comprising:

a substrate;

a light source disposed on the substrate;

a reflective sheet disposed on the substrate;

an optical sheet disposed on the reflective sheet and having a protruding pattern;

an optical resin disposed on the protruding pattern and coupled to the light source; and a first light diffusion sheet disposed on the optical resin wherein the light diffusion sheet is a first light diffusion sheet, the light source module further comprising:

a second light diffusion sheet disposed on the optical resin and spaced apart from the first light diffusion sheet.

9. The light source module of claim 8, wherein the first light diffusion sheet is spaced apart from the second light diffusion sheet in a first direction, and wherein each of the first light diffusion sheet and the second light diffusion sheet extends in a second direction perpendicular to the first direction.

* * * * *